US009697687B2

(12) United States Patent
Koyama et al.

(10) Patent No.: US 9,697,687 B2
(45) **Date of Patent: *Jul. 4, 2017**

(54) GAMING SYSTEM WITH CASINO CHIP TRACKING

(71) Applicant: Universal Entertainment Corporation, Tokyo (JP)

(72) Inventors: Toshimi Koyama, Tokyo (JP); Jun Fujimoto, Tokyo (JP); Nobuyuki Nonaka, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 42 days.

This patent is subject to a terminal disclaimer.

(21) Appl. No.: 14/828,675

(22) Filed: Aug. 18, 2015

(65) Prior Publication Data

US 2015/0356811 A1 Dec. 10, 2015

Related U.S. Application Data

(63) Continuation of application No. 12/716,722, filed on Mar. 3, 2010, now Pat. No. 9,142,092.

(30) Foreign Application Priority Data

Mar. 17, 2009 (JP) ..... 2009-065116

(51) Int. Cl.

| | |
|---|---|
| ***A63F 9/00*** | (2006.01) |
| ***G07F 17/32*** | (2006.01) |
| ***G07F 1/06*** | (2006.01) |

(52) U.S. Cl.

CPC ..... *G07F 17/3251* (2013.01); *G07F 1/06* (2013.01); *G07F 17/322* (2013.01); *G07F 17/3232* (2013.01); *G07F 17/3237* (2013.01); *G07F 17/3241* (2013.01); *G07F 17/3248* (2013.01); *G07F 17/3288* (2013.01)

(58) Field of Classification Search

None

See application file for complete search history.

(56) References Cited

U.S. PATENT DOCUMENTS

| | | | | |
|---|---|---|---|---|
| 5,735,742 | A * | 4/1998 | French | G07F 17/32 273/138.2 |
| 5,770,533 | A | 6/1998 | Franchi | |
| 6,299,534 | B1 | 10/2001 | Breeding | |
| 6,629,591 | B1 | 10/2003 | Griswold | |
| 7,351,145 | B1 | 4/2008 | Ornstein | |
| 7,846,020 | B2 | 12/2010 | Walker | |

(Continued)

*Primary Examiner* — Seng H Lim

(74) *Attorney, Agent, or Firm* — Lex IP Meister, PLLC

(57) ABSTRACT

A gaming system includes: a reader configured to read chip identification information which identifies a chip used in a casino; a writer configured to write validity information, betting information, and information about whether the chip is received from a cashier or from a dealer into chip information based on the chip identification information; and a determination unit configured to determine the validity, the betting state, and the source based on the chip information, wherein the writer is configured to update the validity information from invalid to valid when the chip is handed from the cashier or the dealer to a player and vice versa, to update the betting information as being betted when the chip is placed on a betting area and vice versa.

10 Claims, 10 Drawing Sheets

(56) References Cited

U.S. PATENT DOCUMENTS

| | | | | |
|---|---|---|---|---|
| 7,938,722 | B2 * | 5/2011 | Rowe | A44C 21/00 463/25 |
| 8,021,231 | B2 | 9/2011 | Walker | |
| 8,142,283 | B2 | 3/2012 | Lutnick | |
| 8,608,548 | B2 | 12/2013 | Mattice | |
| 8,616,984 | B2 * | 12/2013 | Mattice | G07F 1/06 463/25 |
| 2004/0009799 | A1 | 1/2004 | Breeding | |
| 2005/0040006 | A1 | 2/2005 | Kodela | |
| 2005/0054445 | A1 | 3/2005 | Gatto | |
| 2006/0030404 | A1 | 2/2006 | Pohlman | |
| 2006/0258427 | A1 | 11/2006 | Rowe | |
| 2006/0264252 | A1 | 11/2006 | White | |
| 2006/0287066 | A1 | 12/2006 | Crawford | |
| 2006/0287067 | A1 | 12/2006 | White | |
| 2006/0287068 | A1 | 12/2006 | Walker | |
| 2006/0287101 | A1 | 12/2006 | Crawford | |
| 2006/0287102 | A1 | 12/2006 | White | |
| 2006/0287103 | A1 | 12/2006 | Crawford | |
| 2006/0287104 | A1 | 12/2006 | White | |
| 2010/0210350 | A9 | 12/2006 | Walker | |
| 2007/0060311 | A1 * | 3/2007 | Rowe | A44C 21/00 463/25 |
| 2007/0105618 | A1 | 5/2007 | Steil | |
| 2007/0117604 | A1 | 5/2007 | Hill | |
| 2007/0213116 | A1 * | 9/2007 | Crawford | G07F 17/322 463/16 |
| 2008/0070667 | A1 | 3/2008 | Lutnick | |
| 2008/0248849 | A1 | 10/2008 | Lutnick | |
| 2009/0061974 | A1 | 3/2009 | Lutnick | |
| 2009/0062017 | A1 | 3/2009 | Kelly | |
| 2009/0069087 | A1 | 3/2009 | Kelly | |
| 2009/0098932 | A1 | 4/2009 | Longway | |
| 2009/0149247 | A1 * | 6/2009 | Esbensen | G07F 17/3239 463/29 |
| 2009/0191933 | A1 | 7/2009 | French | |
| 2010/0016064 | A1 | 1/2010 | Bradshaw | |
| 2010/0093428 | A1 * | 4/2010 | Mattice | G07F 17/3251 463/25 |
| 2010/0093429 | A1 * | 4/2010 | Mattice | G07F 1/06 463/25 |
| 2010/0160032 | A1 * | 6/2010 | Paton | G07F 19/20 463/25 |
| 2010/0167811 | A1 | 7/2010 | Denham | |
| 2010/0210355 | A1 | 8/2010 | Koyama | |
| 2011/0089634 | A1 * | 4/2011 | Thorson | G07F 17/32 273/238 |

* cited by examiner

800

| | | |
|---|---|---|
| 1 | CHIP ID | 801 |
| 2 | BUSINESS SITE IDENTIFICATION INFORMATION | 802 |
| 3 | NOMINAL DISPLAYED AMOUNT | 803 |
| 4 | CHIP STATE INFORMATION | 804 |
| 5 | CHIP HOLDER | 805 |
| 6 | VALID / INVALID STATE | 806 |
| 7 | LATEST VALIDATION DATE AND TIME | 807 |
| 8 | VALIDATION DEVICE INFORMATION | 808 |
| 9 | LATEST INVALIDATION DATE AND TIME | 809 |
| 10 | INVALIDATION DEVICE INFORMATION | 810 |

| DEBTOR | | CREDITOR | |
|---|---|---|---|
| CASH [ASSETS] | $100 | DEPOSIT [DEBT] | $100 |

| DEBTOR | | CREDITOR | |
|---|---|---|---|
| GAMING EXPENDITURE [EXPENSE] | $100 | ARREARAGE [DEBT] | $100 |

| DEBTOR | | CREDITOR | |
|---|---|---|---|
| UNCOLLECTED BALANCE [ASSETS] | $100 | GAMING EARNING [PROFIT] | $100 |
| | | | |
| DEBTOR | | CREDITOR | |
| DEPOSIT [DEBT] | $100 | UNCOLLECTED BALANCE [ASSETS] | $100 |

| DEBTOR | | CREDITOR | |
|---|---|---|---|
| DEPOSIT [DEBT] | $100 | CASH [ASSETS] | $100 |

| DEBTOR | | CREDITOR | |
|---|---|---|---|
| ARREARAGE [DEBT] | $100 | CASH [ASSETS] | $100 |

GAMING SYSTEM WITH CASINO CHIP TRACKING

CROSS REFERENCE TO RELATED APPLICATIONS

This application is a Continuation Application of U.S. patent application Ser. No. 12/716,722 filed on Mar. 3, 2010, which claims priority to Japanese Patent Application No. 2009-065116 filed on Mar. 17, 2009, the contents of which are incorporated herein by reference.

BACKGROUND OF THE INVENTION

1. Field of the Invention

The present invention relates to a gaming system, and more specifically to a gaming system which is capable of controlling a process of a game (such as a card game and a roulette) played in a player-against-computer manner in a casino or the like gaming facility, detecting cheatings, recording in real time the transaction accompanied with transfer of bets and payouts etc. resulting from exchange of casino chips, and then counting and reflecting, onto a balance sheet in real time, occurrence and transfer of assets as actual economic activities between a player and a casino.

2. Description of the Related Art

Games played in conventional casinos are classified roughly into (1) a human-against-human type (for example, a dealer-against-player type) and (2) a human-against-computer type (for example, a player-against-slot machine type).

Table games such as poker, baccarat and roulette fall into the above classification of (1). In order to avoid cheating during the process of the game, behaviors of a dealer need to have no influence upon game results.

Meanwhile, in the conventional casinos, players exchange cash etc. for casino chips at an exchange office, a cashier, or the like place, the casino chips are treated as objects having a value in casinos, and games such as roulette and poker are played by exchange of casino chips.

When a player wins a game, the player is provided with casino chips as a payout by a casino. On the other hand, when a player loses a game, a casino takes the casino chips bet (namely placed onto a table as a wager) by the player. In this manner, exchanges of valuables by using casino chips take place on a gaming table.

A casino needs not only to collect income-and-expense information on an automatic gaming machine such as a slot machine with communication but also to count casino chips, to count cash held at a cashier, and the like for checking revenue (income and expense) derived from games and earnings. At a casino or the like facility which is operated 24 hours a day, however, keeping track of revenue (income and expense) derived from games and earnings accurately in real time is difficult. In particular, it is difficult to keep track of revenue (income and expense) derived from games in real time during a dealer continues to play a game of a table game such as roulette, poker or baccarat.

As a conventional technique for managing casino earnings and the like, it has been proposed to connect a casino gaming machine such as a slot machine to a casino control server, input the earnings derived from the casino gaming machine periodically into the casino control server, and then calculate the earnings, gross profit, etc. by the server (for example, Japanese Unexamined Patent Application Publication No. 2006-338230).

SUMMARY OF THE INVENTION

A gaming system according to an embodiment of the present invention includes: a reader configured to read chip identification information which identifies a chip used in a casino; a writer configured to write validity information about whether the chip is valid, betting information about whether the chip is being betted, and a determination unit configured to determine whether the chip is valid, wherein the writer is further configured to (a) update the validity information of the chip from invalid to valid when the chip is transferred from the casino to a player, (b) update the validity information of the chip from valid to invalid when the chip is transferred from the player to the casino, (c) update the betting information as being betted when the chip is placed on a betting area, and (d) update the betting information as not being betted when a result of a game is determined.

The gaming system may further include: a controller configured to control a process of the game based on the chip identification information read by the reader and generate dealer instructions in response to the process of the game; and an instruction unit configured to output the dealer instructions and to pass on the instructions to a dealer of the game.

The determination unit may be configured to determine abuse of the chip and cheating during the process of the game.

The instructions generated by the controller may include instructions on how to proceed in the game regardless of detection of cheating during the process of the game.

The instructions may include instructions to collect the chip from the player who has lost the game or instructions to provide the chip to the player who has won the game.

A gaming method performed by a gaming system, the method includes: reading, by a chip reader, chip identification information identifying a specific chip among chips used in a casino; writing validity information about whether the chip is valid, betting information about whether the chip is being betted, determining whether the chip is valid, updating the validity information from invalid to valid when the chip is transferred from the casino to a player; updating the validity information from valid to invalid when the chip is transferred from the player to the casino; updating the betting information as being betted when the chip is placed on a betting area, and updating the betting information as not being betted when a result of a game is determined.

The gaming method may further include: controlling a process of the game based on the chip identification information read by the reader; generating dealer instructions in response to the process of the game; and sending the dealer instructions to a dealer of the game.

The gaming method may further include: determining abuse of the chip and cheating during the process of the game.

The instructions generated by the controller may include instructions on how to proceed in the game regardless of detection of cheating during the process of the game.

The instructions may include instructions to collect the chip from the player who has lost the game or instructions to provide the chip to the player who has won the game.

DETAILED DESCRIPTION OF THE EMBODIMENTS

The embodiment of the present invention will be described below with reference to the accompanying drawings.

The embodiment of the present invention is proposed as a gaming system in a casino.

1. Configuration Example of Gaming System

First, a configuration example of a gaming system will be described.

1.1. Overview of Configuration Example

Figure 1:
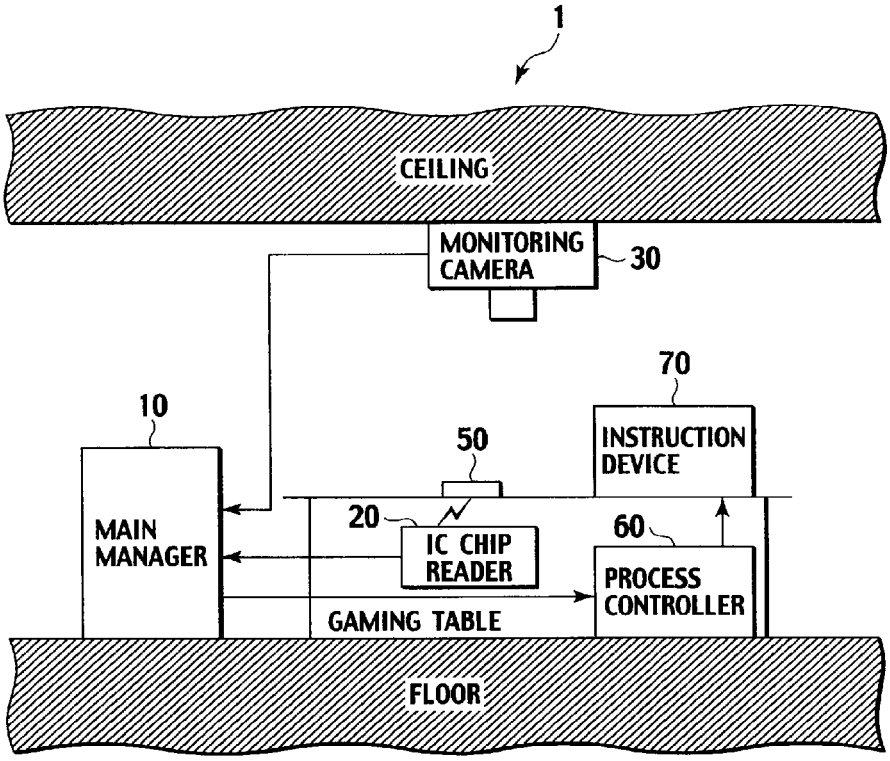
FIG. 1 is a block diagram showing a configuration example of a gaming system.

FIG. 1 is a block diagram showing a configuration example of a gaming system. The gaming system 1 includes: a main manager 10; an IC chip reader 20 connected to the main manager 10 so as to communicate therewith and configured to read a casino chip; a monitoring camera 30 configured to take images of casino chips and players; a casino chip 50 with a built-in IC chip 40 (not shown in FIG. 1); a process controller 60 connected to the main manager 10 so as to communicate therewith; and an instruction device 70 connected to the process controller 60 so as to carry out a process.

1.2. Main Manager

The main manager 10 is implemented, for example, by an information processor such as a computer or a work station. The information processor includes a central processing unit (CPU), a main memory (RAM), a read-only memory (ROM), an input-output unit (I/O), and, if necessary, an external storage unit such as a hard disk drive. Functions and the like of the main manager 10 will be described later.

1.3. IC Chip Reader

Figure 2:
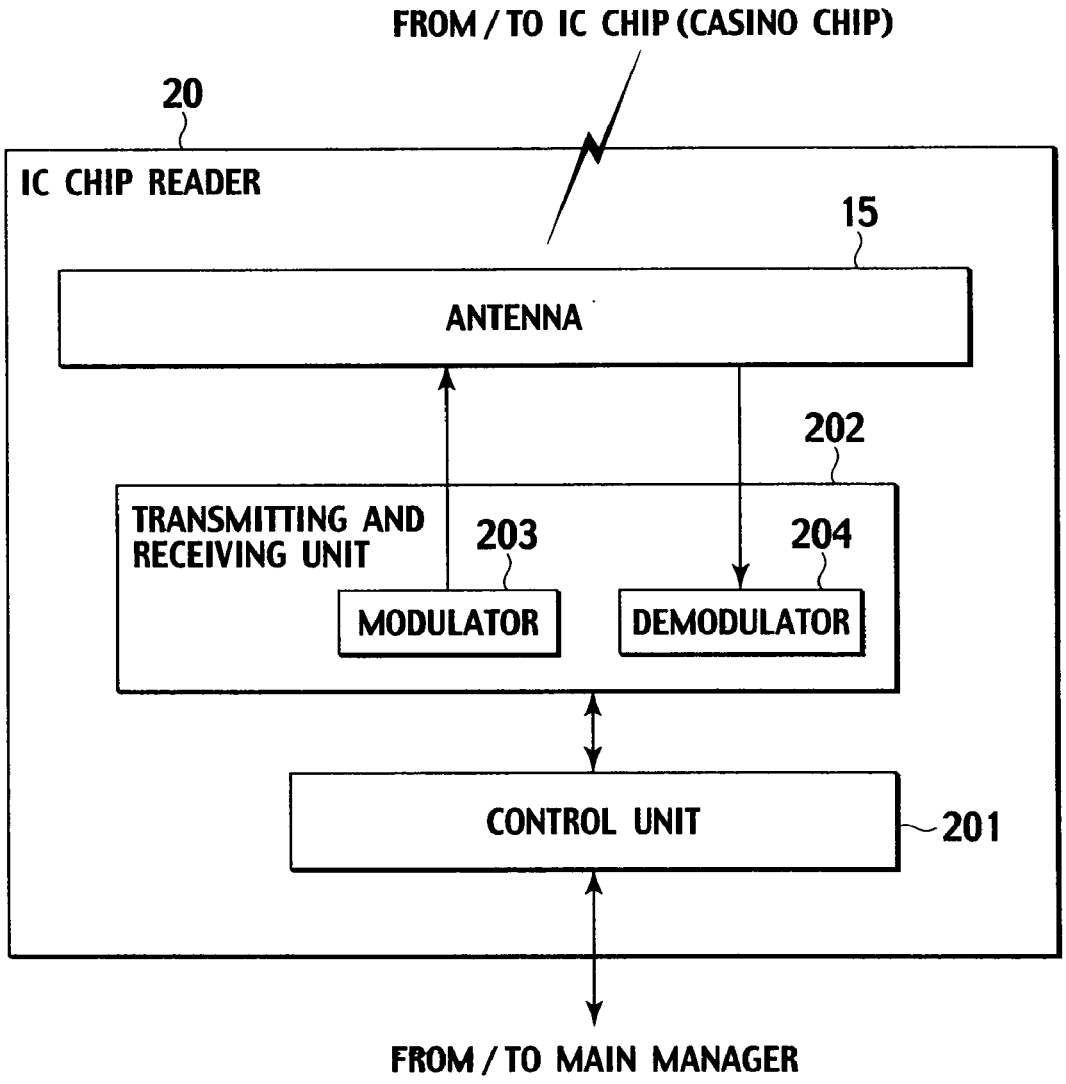
FIG. 2 is a block diagram showing a configuration example of an IC chip reader.

The IC chip reader 20 equivalent to a read unit of the present invention reads, through radio communication, information stored in the IC chip 40 in the casino chip 50 that is a storage medium. FIG. 2 is a block diagram showing a configuration example of the IC chip reader 20.

The IC chip reader 20 includes a control unit 201 and a transmitting and receiving unit 202 connected to the control unit 201. The control unit 201 has a function of receiving an instruction from the main manager 10, driving the transmitting and receiving unit 202 in response to the instruction, and handing over data outputted from the transmitting and receiving unit 202 (data read from the IC chip 40) to the main manager 10. The control unit 201 is, for example, a microcomputer having a CPU, a ROM and a RAM.

The transmitting and receiving unit 202 has a function of transmitting and receiving data by radio to and from the IC chip 40 through an antenna 15. To be more specific, the transmitting and receiving unit 202 includes a modulator 203 and a demodulator 204. The modulator 203 generates a modulated wave by modulating a carrier wave by using a predetermined modulation method based on a base signal corresponding to information such as a predetermined command, request, instruction or the like received from the control unit 201. The demodulator 204 has a function of demodulating a magnetic field which is load-modulated based on a base signal corresponding to the information stored in the IC chip 40, retrieving the base signal corresponding to the data, and handing over the retrieved base signal to the control unit 201. The transmitting and receiving unit 202 is, for example, an RF module having a modulating circuit and a demodulating circuit, or the like.

1.4. Casino Chip and IC Chip

Figure 3:
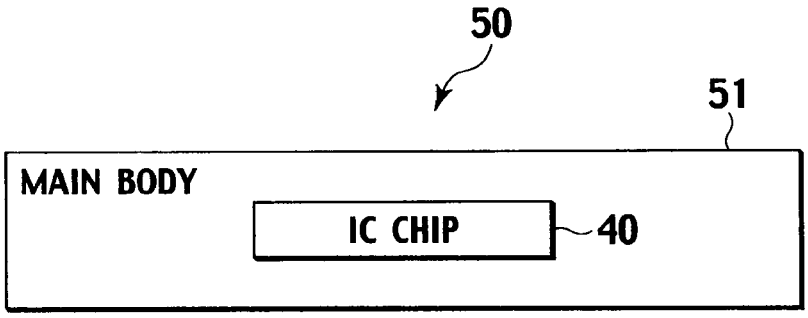
FIG. 3 is a cross-sectional view of a casino chip.

The casino chip 50 is a game medium exchanged between a dealer, a player and the like instead of cash in a casino. The casino chip 50 is generally formed by molding a resin or the like in a coin shape, a disk shape or the like. FIG. 3 is a cross-sectional view of the casino chip 50. The casino chip 50 includes a main body 51 formed of a resin and the IC chip 40 embedded in the main body 51.

The IC chip 40 stores information which can be read according to a read signal from the IC chip reader 20. In general, the IC chip 40 holds information in a readable and writable manner, and allows the stored information to be read and overwritten and new information to be stored as needed. In this embodiment, however, the IC chip 40 stores IC chip identification information (e.g., an ID serial number) which uniquely identifies the casino chip 50 having the IC chip 40 embedded therein.

Figure 4:
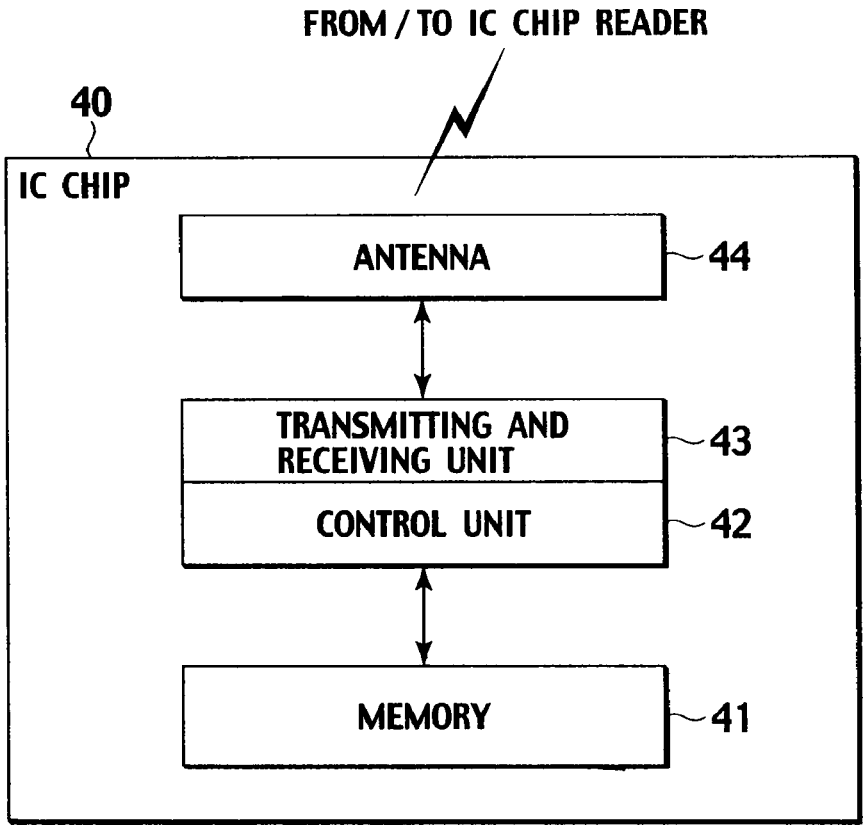
FIG. 4 is a functional block diagram showing a configuration example of an IC chip.

FIG. 4 is a functional block diagram showing a configuration example of the IC chip 40. The IC chip 40 includes a memory 41, a control unit 42, a transmitting and receiving unit 43, and an antenna 44. The memory 41 is a storage storing the IC chip identification information. The control unit 42 interprets a command, request, instruction or the like from the IC chip reader 20, and executes an operation in response thereto. The transmitting and receiving unit 43 includes a modulator (not shown) and a demodulator (not shown), and performs signal modulation and demodulation for transmitting and receiving data by radio to and from the IC chip reader 20. The antenna 44 receives a modulated wave from the antenna 15 of the IC chip reader 20 and transmits the received modulated wave to the transmitting and receiving unit 43, while receiving a modulated signal from the transmitting and receiving unit 43, and emitting the modulated signal into the air in order for the antenna 15 to receive the modulated signal.

1.5. Monitoring Camera

The monitoring camera 30 generates image data on a player for recognizing the player (e.g., the face of the player, clothes of a person whose image is taken, movement of his/her hand, and the like), and transmits the image data together with an image of the casino chip 50 to the main manager 10.

1.6. Process Controller

The process controller 60 equivalent to a control unit of the present invention has a function of determining a progress of a game based on a transfer situation of the casino chip 50 transmitted from the main manager 10, and the like, generating instruction information which instructs a dealer what to do based on the determination result, and outputting the instruction information to the instruction device 70.

The process controller 60 is implemented, for example, by an information processor such as a computer or a work station. The information processor includes a central processing unit (CPU), a main memory (RAM), a read-only memory (ROM), an input-output unit (I/O), and, if necessary, an external storage unit such as a hard disk drive.

A configuration of the process controller will be described later.

1.7. Instruction Device

The instruction device 70 equivalent to an instruction unit of the present invention has a function of outputting the instruction information from the process controller 60 and transmitting instruction contents to the dealer. The instruction contents may be transmitted to the dealer through images, sounds and the like. The instruction device 70 is, for example, a liquid crystal display device, a head set or the like. The instruction contents may be treated as instruction information related to any of the process of a game, such as collecting casino chips 50 from a player who has lost the game, providing casino chips 50 to a player who has won the game, and drawing or standing a card in the case of a card game.

1.8. Component Arrangement Example

Figure 5:
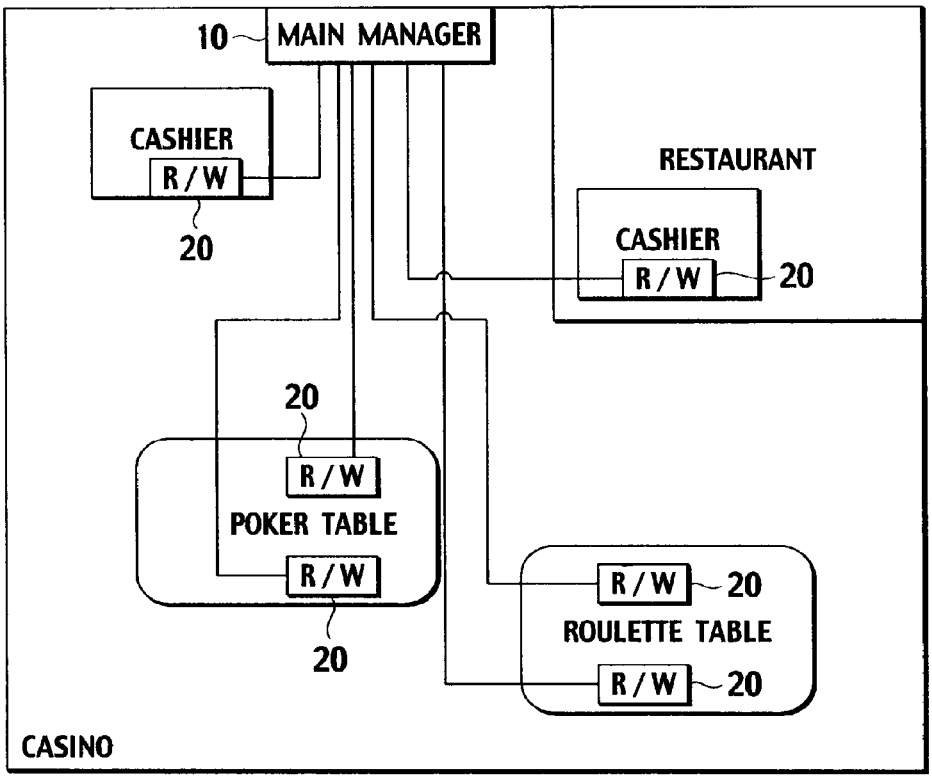
FIG. 5 is a diagram showing an example of arrangement of components included in the gaming system.

FIG. 5 is a diagram showing an example of arrangement of the components included in the gaming system 1. In a casino, cashiers are provided for players to exchange cash or the like for the casino chips 50. At each of the cashiers, the IC chip reader 20 for the cashier is placed. A cashier operator uses the IC chip reader 20 to read the IC chip 40 in exchanging cash or the like for the casino chips 50.

Moreover, in the casino, a poker table and a roulette table are placed as gaming tables for playing a game. On the underside or the like of the table top of the poker table or roulette table, the IC chip reader 20 is provided. The IC chip readers 20 thus provided include the one used by the dealer and the one used by each player.

At each of the poker table and roulette table, the process controller 60 and the instruction device 70 are provided (the process controller 60 and the instruction device 70 are not shown in FIG. 5).

Furthermore, the casino has facilities (such as a store and a restaurant) where the casino chips 50 can be used for payment in the same manner as cash, and a cashier in each of such facilities is also provided with the IC chip reader 20.

1.9. Arrangement Example of IC Chip Reader at Gaming Table

Figure 6:
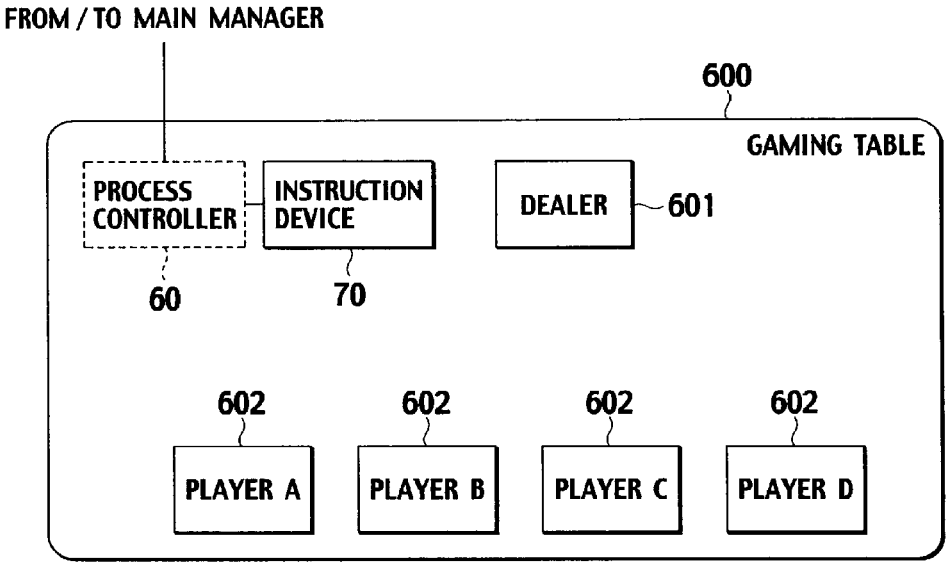
FIG. 6 is a diagram showing an example of a table top when a certain gaming table is viewed from above.

A more specific example of the IC chip reader 20 provided on a gaming table will be described. FIG. 6 is a diagram showing an example of a table top when a certain gaming table 600 is viewed from above. At the gaming table 600, an IC chip reading area 601 for a dealer and IC chip reading areas 602 for players are provided. On the underside of the table corresponding to the IC chip reading areas 601 and 602, the IC chip readers 20 are provided so that, when the casino chips 50 are placed in the IC chip reading areas 601 and 602, the IC chip readers 20 can read the IC chip identification information from the IC chips 40 in the casino chips 50.

1.10. Configuration Example of Main Manager

Figure 7A:
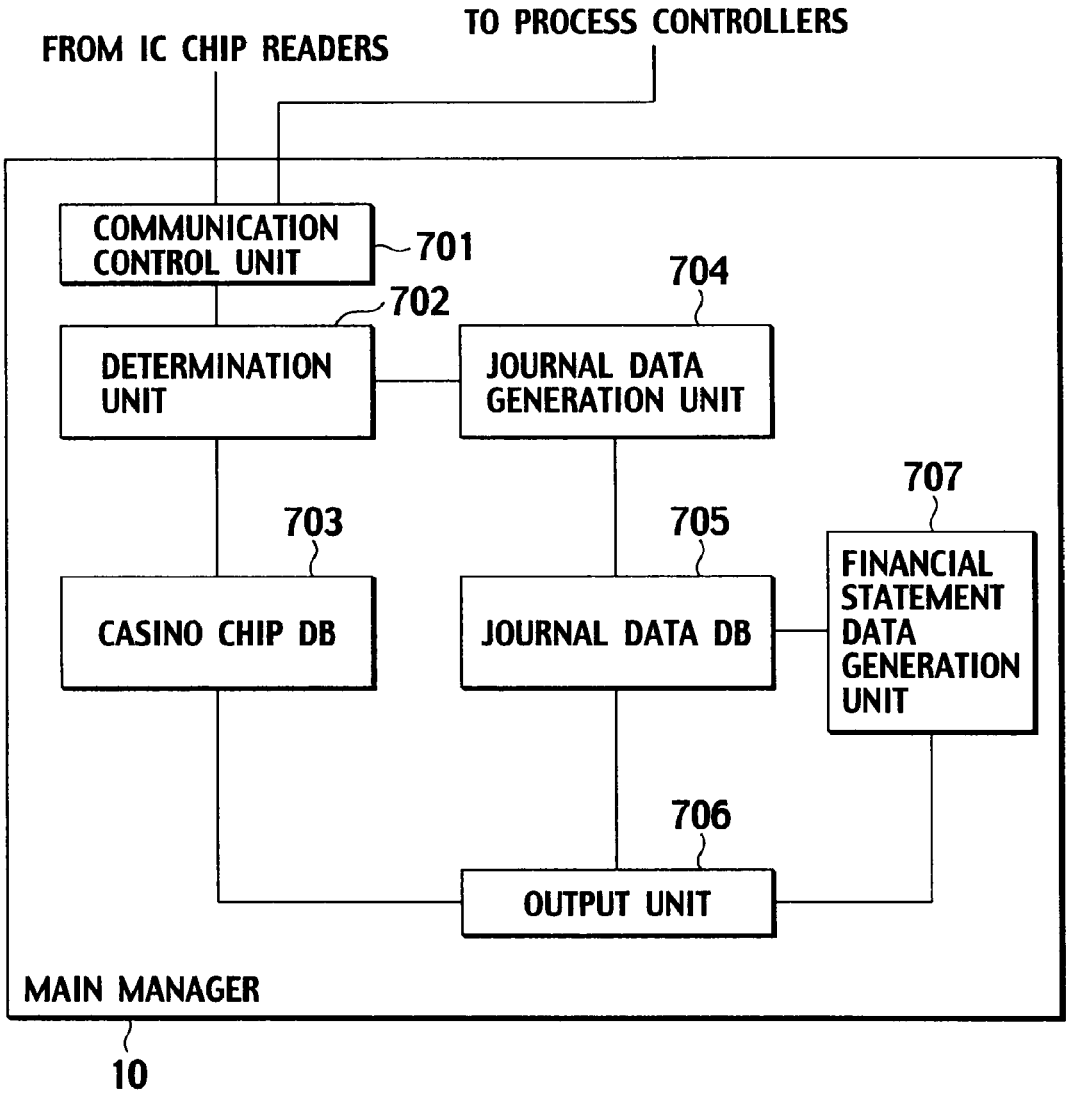
FIG. 7A is a functional block diagram showing a configuration example of a main manager.

A configuration example of the main manager 10 will be described. FIG. 7A is a functional block diagram showing the configuration example of the main manager 10. Note that respective components correspond to functions implemented by a CPU and programs executed by the CPU. Therefore, the main manager 10 need not actually include hardware corresponding to each of the components.

The main manager 10 includes: a communication control unit 701 connected to the IC chip readers 20 and the process controllers 60; a determination unit 702 connected to the communication control unit 701; a casino chip data base (hereinafter referred to as DB) 703 connected to the determination unit 702; a journal data generation unit 704 connected to the determination unit 702; a journal data DB 705 connected to the journal data generation unit 704; an output unit 706 connected to the casino chip DB 703 and the journal data DB 705; and a financial statement data generation unit 707 connected to the journal data DB 705. Note that "connection" here means not only a physically connected state but also a data exchangeable state. Here, the determination unit 702 corresponds to a determination unit of the present invention, the journal data generation unit 704 corresponds to a first generation unit of the present invention, the journal data DB 705 corresponds to an accumulation unit of the present invention, the financial statement data generation unit 707 corresponds to a second generation unit of the present invention, and the output unit 706 corresponds to an output unit of the present invention.

The communication control unit 701 has a function of communicating with the IC chip readers 20 so as to receive data transmitted from the IC chip readers 20. Each of the IC chip readers 20 transmits, to the main manager 10 according to a predetermined protocol, the read IC chip identification information, reader identification information (e.g., a reader ID) which identifies the IC chip reader 20, read date and time information, and the like.

The communication control unit 701 then transmits the data received from the IC chip reader 20 to a corresponding one of the process controllers 60.

The determination unit 702 has a function of updating data stored in the casino chip DB 703 based on the IC chip identification information and reader identification information received through the communication control unit 701 and the data stored in the casino chip DB 703, and generating journal data for determining contents of journal corresponding to a transaction made between a casino and a player when reading is performed by the IC chip reader 20.

Furthermore, the determination unit 702 refers to the contents stored in the casino chip DB 703 and determines whether or not the IC chip 40 read by the IC chip reader 20 is illegitimate. If the IC chip 40 is illegitimate, the determination unit 702 transmits to the corresponding process controller 60 a message notifying the process controller 60 that an illegitimate casino chip 50 is being used.

Figures 7B, 8:
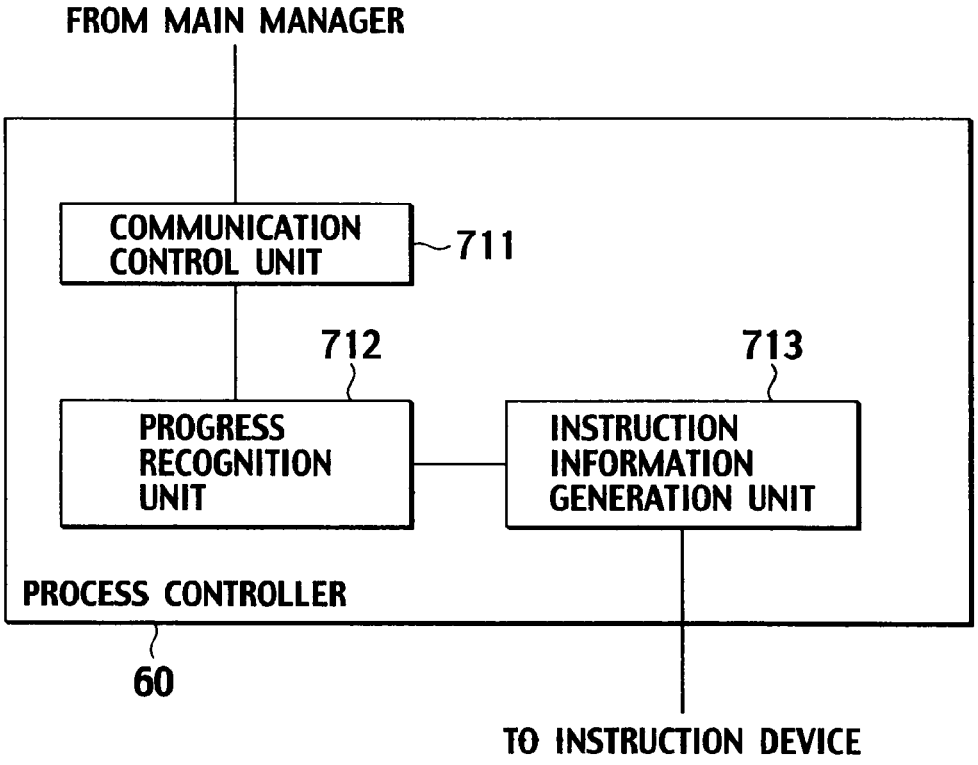
FIG. 7B is a diagram showing a data configuration example of one of the records stored in a casino chip DB.
FIG. 8 is a functional block diagram showing a configuration example of a process controller.

The casino chip DB 703 has a function of storing various kinds of information on each of the casino chips 50 in association with the IC chip identification information. The casino chip DB 703 has one record for each casino chip 50. FIG. 7B is a diagram showing a data configuration example of one of the records stored in the casino chip DB 703. A record 800 has a chip ID field 801, a business site identification information field 802, a nominal displayed amount field 803, a chip state information field 804, a chip holder field 805, a valid/invalid state field 806, a latest validation date and time field 807, a validation device information field 808, a latest invalidation date and time field 809, and an invalidation device information field 810.

The chip ID field 801 stores the IC chip identification information stored in the IC chip 40. The business site identification information field 802 stores information which identifies a gaming facility, a hotel or the like where a certain casino chip 50 is used. The nominal displayed amount field 803 stores a value of a displayed amount of the casino chip 50. For example, the value stored in the nominal displayed amount field 803 is "10" when the casino chip 50 is $10, and is "100" when the casino chip 50 is $100. The chip state information field 804 stores information indicating an accounting state of the casino chip 50 (e.g., journal data). The chip holder field 805 stores information indicating a holder of the casino chip 50, for example, a player identification number and the like. The valid/invalid state field 806 stores information indicating whether the casino chip 50 is valid. The casino chip 50 is validated when the casino chip 50 is read by the IC chip reader 20 at the cashier during handing over of the casino chip 50 in exchange for cash payment at the cashier in the casino. The cashier or dealer checks if the casino chip 50 is valid using the IC chip reader 20 upon receipt of the casino chip 50 from the player. The valid casino chip 50 may be placed onto a table as a wager, exchanged for cash at the cashier or used for payment instead of cash at a facility such as a restaurant. By contrast, an invalid casino chip 50 cannot be used in that manner. This determination is made by the determination unit 702 of the main manager 10.

The latest validation date and time field 807 stores the last date and time the casino chip 50 was validated. The validation device information field 808 stores information which identifies the IC chip reader 20 that carried out reading of the IC chip 40 in the casino chip 50 the last time the casino chip 50 was validated. The latest invalidation date and time field 809 stores the last date and time the casino chip 50 was invalidated. The invalidation device information field 810 stores information which identifies the IC chip reader 20 that carried out reading of the IC chip 40 in the casino chip 50 the last time the casino chip 50 was invalidated.

The journal data generation unit 704 has a function of generating journal data (information including line items of a creditor and a debtor and amounts thereof) corresponding to a transaction state of the casino chip 50 when the IC chip 40 in the casino chip 50 is read by the IC chip reader 20.

The journal data DB 705 generates journal book data by accumulatively storing the journal data generated by the journal data generation unit 704, and generates general ledger data based on the journal book data. The general ledger data represents a balance of the line items included in the journal data.

The output unit 706 has a function of allowing an operator or the like to view the contents stored in the casino chip DB 703 and the journal data DB 705. The output unit 706 is, for example, a liquid crystal display device, a printer or the like.

The financial statement data generation unit 707 performs processing of counting the journal data accumulated in the journal data DB 705, and the like, and generates, based on this processing, data corresponding to data showing the state of property and the state of profit and loss of the casino, the balance sheet data, a tax amount calculated based on the journal data accumulated in the accumulation unit, and the like. The generated data is handed over to the output unit 706, and various ledger sheets are outputted, such as a journal book, a general ledger, an auxiliary book, a trial balance, a profit-and-loss statement, a balance sheet, and a tax return form. Note that a user may freely determine, by his/her own choice, which one of the ledger sheets is to be outputted.

1.11. Configuration of Process Controller

Next, a configuration example of the process controller 60 will be described. FIG. 8 is a functional block diagram showing the configuration example of the process controller 60. The process controller 60 includes a communication control unit 711, a progress recognition unit 712 connected to the communication control unit 711, and an instruction information generation unit 713 connected to the progress recognition unit 712.

The communication control unit 711 receives from the main manager 10 the read data on the IC chip 40 received from the IC chip reader 20. The communication control unit 711 also receives from the main manager 10 a message notifying that an illegitimate casino chip 50 is being used.

The progress recognition unit 712 has a function of recognizing a progress of a game at a gaming table under the control of the process controller 60 based on, for example, the read data on the IC chip 40 received from the IC chip reader 20, and determining what kind of instruction is to be given next to the dealer. In addition, the progress recognition unit 712 also has a function of issuing a warning to the dealer through the instruction device 70 based on the message notifying that an illegitimate casino chip 50 is being used, or sending out a warning message (e.g., transmitting an e-mail or sending an automatic sound notification) to a predetermined contact point such as a security at the casino.

The instruction information generation unit 713 has a function of generating information (such as image data or audio data) for allowing the instruction device 70 to output an instruction to be issued to the dealer, based on the determination made by the progress recognition unit 712. For example, the instruction information generation unit 713 performs processing of generating a test message such as "Draw another card from the dealer's cards" or audio data such as "Dealer, stand", and the like.

2. Operation Example of Gaming System

Next, an operation example of the gaming system 1 will be described.

2.1. Lending of Casino Chip

Figures 9, 10:
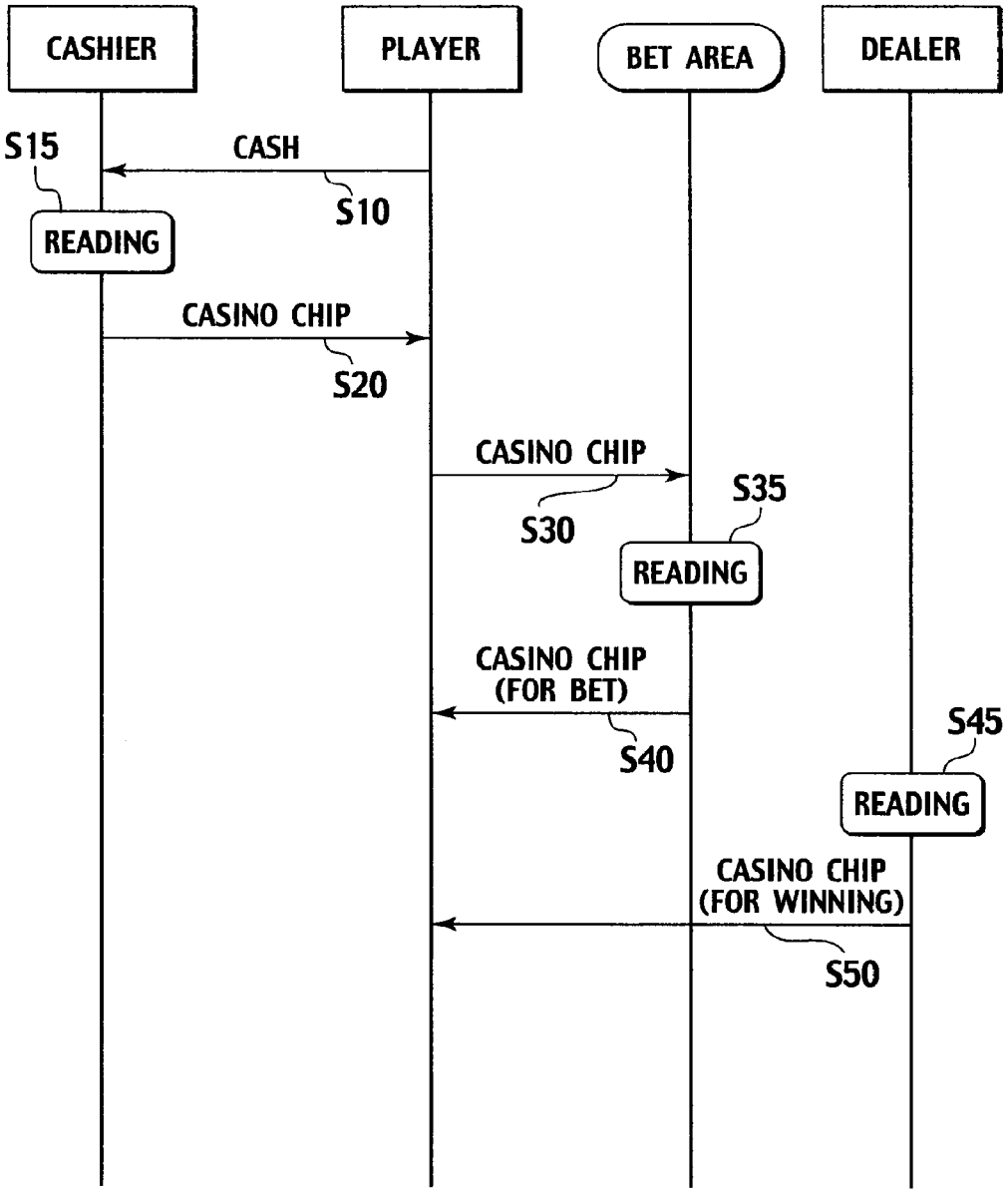
FIG. 9 is a sequence diagram showing how cash and casino chips are transferred.
FIG. 10 is a diagram showing a data configuration example of journal data generated after completion of S10 in FIG. 9.

First, a player needs to acquire casino chips 50 before playing a game at a casino. Here, the player acquires casino chips 50 in exchange for cash at a cashier in a casino. FIG. 9 is a sequence diagram showing how cash and casino chips 50 are transferred when the player acquires casino chips 50 in exchange for cash at a cashier in the casino, plays a game and then acquires additional casino chips 50 as a payout by winning the game.

First, the player gives cash to a cashier operator (S10). The cashier operator keeps the received cash in a safe or the like, and allows the IC chip reader 20 for the cashier operator to read the stored casino chips 50 corresponding to the amount of the received cash.

In the casino chip DB 703 in the main manager 10, each of the stored casino chips 50 is recorded as being in an invalid state before being read by the IC chip reader 20 for the cashier operator. After the casino chip 50 is read by the IC chip reader for the cashier operator, the main manager 10, more specifically, the determination unit 702 uses the read IC chip identification information as a key to extract a record corresponding thereto in the casino chip DB 703 in the main manager 10, and then writes, in the record, more specifically, the valid/invalid state field 806, data indicating "Valid" meaning that the casino chip 50 having the IC chip 40 is turned into a valid state. In the chip state information field 804, information indicating that the player has exchanged cash for casino chips 50 (which is called chip transaction state information) is written. At the same time, time information related thereto is written in the latest validation date and time field 807, and information which can identify the cashier is written in the validation device information field 808.

In such a record in the casino chip DB 703, information useful for reference in case of occurrence of some problem later or in case of taking statistics is written.

Furthermore, the determination unit 702 in the main manager 10 hands over the information written in the chip state information field 804 to the journal data generation unit 704. The journal data generation unit 704 generates journal data based on the chip transaction state information. FIG. 10 shows a data configuration example of the journal data generated after completion of S10. In the example shown in FIG. 10, a creditor and a debtor each have a line item and an amount in the journal data. This example uses journal data generated for one casino chip 50 having a display amount of $100. The line item of the debtor is a gaming expenditure (expense), and the gaming expenditure (expense) is described as being increased by $100. The line item of the debtor is cash (assets), and the cash (assets) is described as being increased by $100. The line item of the creditor is a deposit (debt), and the deposit (debt) is described as being increased by $100.

If the player gives out $1000 cash and receives ten $100 casino chips 50, ten pieces of the journal data shown in FIG. 10 are generated. The generated journal data is handed over to and stored in the journal data DB 705.

2.2. When Player Wins a Game

Referring back to FIG. 9, a description will be given of an operation example of the gaming system 1 when the player who has received the casino chips 50 plays a game at a gaming table, takes back the bet casino chips by winning the game, and acquires casino chips 50 as a payout from the dealer.

The player places casino chips 50 as a wager in a bet area on the gaming table (S30). Below the bet area, an IC chip reader 20 is installed. IC chip identification information on the placed casino chips 50 is read by the IC chip reader 20 and then transmitted to the main manager 10. The determination unit 702 in the main manager 10 extracts a record corresponding to the received IC chip identification information from the casino chip DB 703, and determines whether the casino chips 50 corresponding to the IC chip identification information are valid. When the casino chips 50 are invalid, the determination unit 702 generates and outputs a message notifying the player, dealer or security that those casino chips 50 cannot be used. At the same time, the determination unit 702 writes information indicating that a bet is being placed into the chip state information field 804 of the corresponding record in the casino chip DB 703.

At this point, the determination unit 702 hands over the information written into the chip state information field 804 to the journal data generation unit 704. The journal data generation unit 704 generates journal data based on the chip transaction state information.

It is assumed here that an outcome of the game is determined and the player wins the game and is provided with a payout. In this case, the casino chips 50 placed in the bet area are all returned to the player who has made the bet (S4). At the same time, a record corresponding to the casino chip 50 is extracted from the casino chip DB 703, and information indicating that the casino chip 50 is no longer being bet is written into the chip state information field 804. This is in order to detect a cheating when a casino chip 50 which is supposed to be in the middle of a game is exchanged for cash at a cashier or the like since the casino chip 50 that is being bet is a deposit that cannot be exchanged for cash until the game is finished and winning or losing is determined.

Furthermore, the dealer provides the player with the casino chips 50 as a payout (S50). The dealer allows the IC chip reader 20 for the dealer to read the casino chips 50 kept at hand or the like corresponding to the payout. The read IC chip identification information is transmitted to the main manager 10.

In the casino chip DB 703 in the main manager 10, each of the stored casino chips 50 is recorded as being in an invalid state before being read by the IC chip reader 20 for the dealer.

Figures 11, 12, 13:
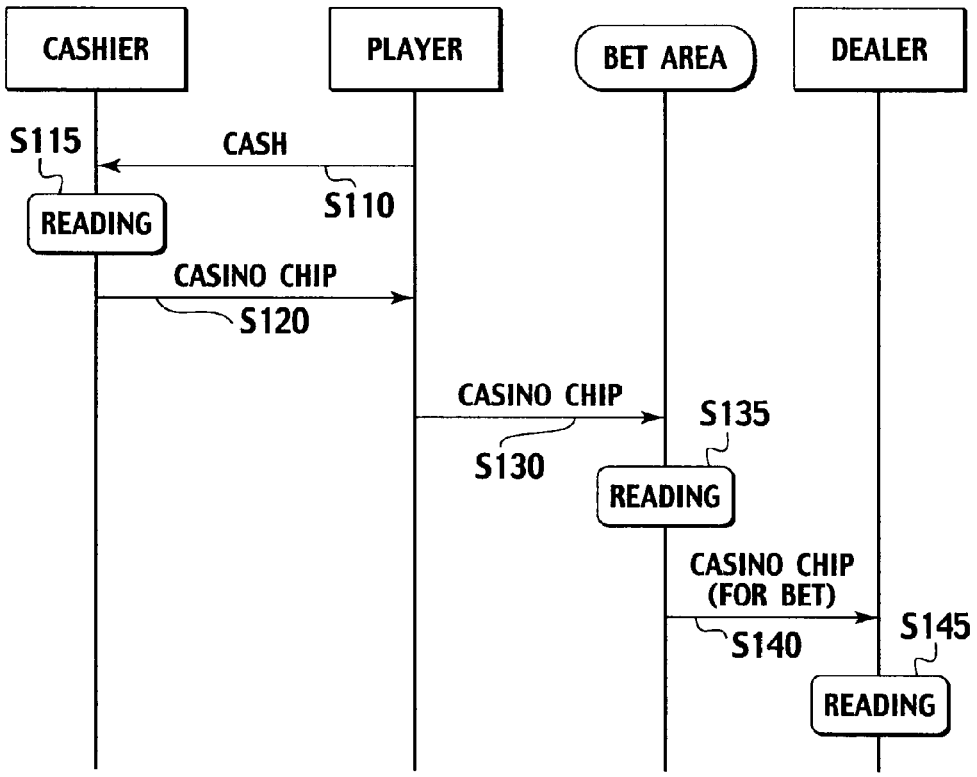
FIG. 11 is a diagram showing a data configuration example of journal data generated prior to S50 in FIG. 9.
FIG. 12 is a sequence diagram showing how cash and casino chips are transferred when a dealer wins a game and acquires casino chips that are bet.
FIG. 13 is a diagram showing a data configuration example of journal data generated after S145 in FIG. 12.

After the casino chip 50 is read by the IC chip reader 20 for the dealer, the main manager 10, more specifically, the determination unit 702 uses the read IC chip identification information as a key to extract a record corresponding thereto in the casino chip DB 703 in the main manager 10, and then writes, in the record, more specifically, the valid/invalid state field 806, data indicating "Valid" meaning that the casino chip 50 having the IC chip 40 is turned into a valid state. In the chip state information field 804, information indicating that the player is provided with a payout (which is called chip transaction state information) is written. Furthermore, the determination unit 702 in the main manager 10 hands over the information written into the chip state information field 804 to the journal data generation unit 704. The journal data generation unit 704 generates journal data based on the chip transaction state information. FIG. 11 shows a data configuration example of journal data generated prior to S50. This example uses journal data when the dealer provides the player with a $100 casino chip 50 as a payout. The line item of the debtor is a gaming expenditure (expense), and the gaming expenditure (expense) is described as being increased by $100. The line item of the creditor is an arrearage (debt), and the arrearage (debt) is described as being increased by $100.

The determination unit 702 rewrites the contents in the chip state information field 804 of the corresponding record into the above contents. The generated journal data is transmitted to and accumulated in the journal data DB 705.

2.3. When Player Loses a Game

Next, a description will be given of an operation example of the gaming system 1 when the player loses a game. FIG. 12 is a sequence diagram showing how cash and casino chips 50 are transferred when the player acquires casino chips 50 in exchange for cash at a cashier in the casino and plays a game, and then the dealer acquires casino chips 50 that are bet by winning the game.

The steps of the player exchanging cash for casino chips 50 at a cashier and placing the casino chips 50 as a wager in a bet area on the gaming table (S110 to S135) are the same as S10 to S35 in FIG. 9, and thus a description thereof will be omitted.

After S35, the casino chips 50 placed in the bet area is confiscated by the dealer since the player has lost the game (S140). The dealer moves the casino chips 50 placed in the bet area to a reading area of the IC chip reader 20 for the dealer, and then allows the IC chip reader 20 for the dealer to read the confiscated casino chips 50 (S145). The read IC chip identification information is transmitted to the main manager 10.

In the casino chip DB 703 in the main manager 10, each of the confiscated casino chips 50 is recorded as being in a valid state before being read by the IC chip reader 20 for the dealer. After the casino chip 50 is read by the IC chip reader 20 for the dealer, the main manager 10, more specifically, the determination unit 702 uses the read IC chip identification information as a key to extract a record corresponding thereto in the casino chip DB 703 in the main manager 10, and then writes, in the record, more specifically, the valid/invalid state field 806, data indicating "Invalid" meaning that the casino chip 50 having the IC chip 40 is turned into an invalid state. In the chip state information field 804, information indicating that the casino chip 50 is confiscated from the player (which is called chip transaction state information) is written. Furthermore, the determination unit 702 in the main manager 10 hands over the chip transaction state information to the journal data generation unit 704. The journal data generation unit 704 generates journal data based on the chip transaction state information. FIG. 13 shows a data configuration example of journal data generated after S145.

This example uses journal data when the player hands over a $100 casino chip 50 that he/she has lost to the dealer. In this example, two kinds of journal data are generated for one casino chip 50. In one of the journal data, the line item of the debtor is an uncollected balance (assets), and the uncollected balance (assets) is described as being increased by $100. The line item of the creditor is a gaming earning (profit), and the gaming earning (profit) is described as being increased by $100. The other journal data is the one for balancing the deposit from the player. The line item of the debtor is a deposit (debt), and the deposit (debt) is described as being decreased by $100. The line item of the creditor is an uncollected balance (assets), and the uncollected balance (assets) is described as being decreased by $100.

Furthermore, the determination unit 702 rewrites the contents in the chip state information field 804 of the corresponding record into the above contents.

2.4. Exchange of Casino Chip for Cash

Figures 14, 15, 16:
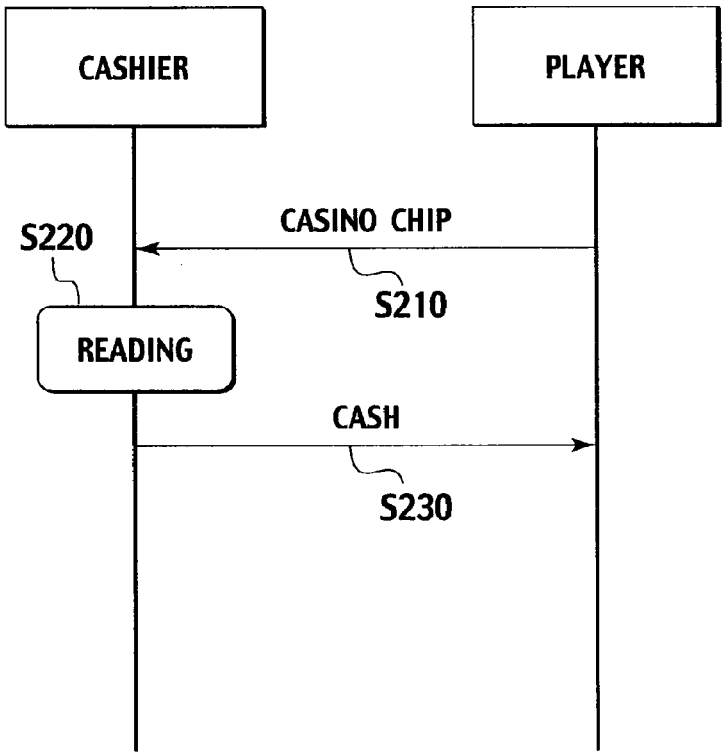
FIG. 14 is a sequence diagram showing the transfer of cash and casino chips when a player exchanges casino chips for cash.
FIG. 15 is a diagram showing a data configuration example of journal data generated by a journal data generation unit.
FIG. 16 is a diagram showing a data configuration example of journal data generated by the journal data generation unit.

Next, a description will be given of a case where the player exchanges casino chips 50 for cash at a cashier. FIG. 14 is a sequence diagram showing the transfer of cash and casino chips 50 when the player exchanges casino chips 50 for cash.

First, the player hands a desired number of casino chips 50 to the cashier operator (S210). The cashier operator allows the IC chip reader 20 for the cashier operator to read the received casino chips 50 (S220).

In the casino chip DB 703 in the main manager 10, each of the casino chips 50 needs to be recorded as being in a valid state before being read by the IC chip reader 20 for the cashier operator. The casino chip 50 in an "invalid state" is the one resulting from some kind of cheating.

After the casino chip 50 is read by the IC chip reader for the cashier operator, the main manager 10, more specifically, the determination unit 702 uses the read IC chip identification information as a key to extract a record corresponding thereto in the casino chip DB 703 in the main manager 10, and then determines whether or not the casino chip 50 is in a "valid state". When there is a casino chip 50 in the invalid state, display of a warning message or the like is performed. In addition, even when the casino chip 50 is in the valid state, the casino chip 50 that is being bet is also the one resulting from some kind of cheating. Similarly, when the IC chip identification information cannot be read and when the content of the business site identification information field 802 in the corresponding record in the casino chip DB 703 is determined to be neither a casino nor a hotel group to which the cashier belongs, display of a warning message or the like is performed.

As for the casino chip 50 in the valid state, the determination unit 702 writes, in the record, more specifically, the valid/invalid state field 806, data indicating "Invalid" meaning that the casino chip 50 having the IC chip 40 is turned into an invalid state. In the chip state information field 804, information indicating that the casino chip 50 is exchanged for cash (which is called chip transaction state information) is written. At the same time, time information related thereto is written in the latest invalidation date and time field 809, and information which can identify the cashier is written in the invalidation device information field 810.

For the casino chip 50 read in S220, the determination unit 702 causes the journal data generation unit 704 to generate journal data. The journal data in this case varies depending on whether the casino chip 50 is received from the cashier or from the dealer. The determination of whether the casino chip 50 is received from the cashier or from the dealer is made by the determination unit 702 referring to the record in the casino chip DB 703, more specifically, the chip state information, the latest validation device information, and the like.

First, a description will be given of a case where the casino chip 50 is the one received from the cashier. FIG. 15 is a diagram showing a data configuration example of journal data generated by the journal data generation unit 704 when the casino chip 50 to be exchanged is the one received from the cashier. In this example, the line item of the debtor is a deposit (debt), and the deposit (debt) is described as being decreased by $100. The line item of the creditor is cash (assets), and the cash (assets) is described as being decreased by $100.

Next, a description will be given of a case where the casino chip 50 to be exchanged is the one received from the dealer.

FIG. 16 is a diagram showing a data configuration example of journal data generated by the journal data generation unit 704 when the casino chip 50 to be exchanged is the one received from the dealer. In this example, the line item of the debtor is an arrearage (debt), and the arrearage (debt) is described as being decreased by $100. The line item of the creditor is cash (assets), and the cash (assets) is described as being decreased by $100.

Note that, after the reading described above (S220), the cashier provides the player with cash or an object having a value such as a check, which corresponds to the total nominal displayed amount of the casino chips 50.

Besides the management operation of the main manager 10, the process controller 60 controls a process of a game on the gaming table under the control thereof and keeps issuing process instructions to the dealer.

3. Summary

The journal data described above is generated in real time at the time of occurrence of the transfer of the casino chip (reading by the IC chip reader 20), and is accumulated in the journal data DB 705. Counting this journal data for each line item makes it possible to immediately calculate at any time a total balance of deposits, a total balance of gaming earnings and a total balance of gaming expenditures in the casino at the current point of time. The present invention thus makes it possible to constantly keep track of the income-and-expense condition of the casino.

Moreover, the present invention makes it possible to detect the use of illegitimate casino chips in real time and to improve the soundness of casino business.

The latest state when the player places a bet or when an outcome of a game is determined and a payout is provided is reflected on the total balance of deposits, the total balance of gaming earnings and the total balance of gaming expenditures in the casino. The present invention thus makes it possible to keep track of the financial condition and earning condition in real time.

4. Modified Embodiment and Others

In the above embodiment, the process controller 60 mainly functions to cause the instruction device 70 to send an instruction to the dealer. However, the present invention is still implemented even when the process controller 60 is modified so as to perform a part of the process of a game. For example, in the case of a card game such as poker, a card feeder (not shown) which is controlled by the process controller 60 may be provided on a gaming table and the card feeder may feed a required number of cards to a dealer and a player in accordance with the process of a game. Here, the card feeder takes out (ejects) a specified number of cards from a pile of cards stored in a card stock. Meanwhile, in the case of a roulette game, a roulette game may be executed by causing the process controller 60 to control a roulette machine capable of throwing a ball into a roulette wheel and automatically reading a stop position of the ball.

According to the present invention, it is possible to control a game under computer control while maintaining the game to be played in a human-against-human manner and also eliminate cheatings which may occur during the process of the game.

Furthermore, according to the present invention, it is possible to record the transaction between a casino (a gaming facility) and a player in real time and keep track of income and expense of the gaming facility or the player accurately in real time in accordance with the viewpoint of the accrual accounting.

As a result, it is possible to keep track of earnings derived from a game accurately in real time at an automatic gaming machine such as a slot machine with communication as well as in a game which comprises a dealer and casino chips.

In the prior art, since casino chips have a value, they need to be managed with equal strictness as in handling cash. By introduction of the system of the present invention, however, strict management of casino chips is made to be not necessary because they have no value (casino chips which are not effective on DB cannot be exchanged for cash), and therefore it is possible to substantially reduce cost in management.

The gaming system according to the embodiment of the present invention has been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiment of the present invention are only a list of optimum effects achieved by the present invention. Hence, the effects of the present invention are not limited to those described in the embodiment of the present invention.

What is claimed is:

1. A gaming system comprising:

a reader configured to read chip identification information which identifies a chip used in a casino;

a writer configured to write validity information about whether the chip is valid, betting information about whether the chip is being betted, and a determination unit configured to determine whether the chip is valid, wherein the writer is further configured to (a) update the validity information of the chip from invalid to valid when the chip is transferred from the casino to a player, (b) update the validity information of the chip from valid to invalid when the chip is transferred from the player to the casino, (c) update the betting information as being betted when the chip is placed on a betting area, and (d) update the betting information as not being betted when a result of a game is determined.

2. The gaming system of claim 1, further comprising:

a controller configured to control a process of the game based on the chip identification information read by the reader and generate dealer instructions in response to the process of the game; and an instruction unit configured to output the dealer instructions and to pass on the instructions to a dealer of the game.

3. The gaming system of claim 2, wherein the determination unit is configured to determine abuse of the chip and cheating during the process of the game.

4. The gaming system of claim 3, wherein the instructions generated by the controller include instructions on how to proceed in the game regardless of detection of cheating during the process of the game.

5. The gaming system of claim 3, wherein the instructions include instructions to collect the chip from the player who has lost the game or instructions to provide the chip to the player who has won the game.

6. A gaming method performed by a gaming system, the method comprising:

reading, by a chip reader, chip identification information identifying a specific chip among chips used in a casino;

writing validity information about whether the chip is valid, betting information about whether the chip is being betted, determining whether the chip is valid, updating the validity information from invalid to valid when the chip is transferred from the casino to a player;

updating the validity information from valid to invalid when the chip is transferred from the player to the casino;

updating the betting information as being betted when the chip is placed on a betting area, and updating the betting information as not being betted when a result of a game is determined.

7. The gaming method of claim 6, further comprising:

controlling a process of the game based on the chip identification information read by the reader;

generating dealer instructions in response to the process of the game; and sending the dealer instructions to a dealer of the game.

8. The gaming method of claim 7, further comprising:

determining abuse of the chip and cheating during the process of the game.

9. The gaming method of claim 8, wherein the instructions generated by the controller include instructions on how to proceed in the game regardless of detection of cheating during the process of the game.

10. The gaming method of claim 8, wherein the instructions include instructions to collect the chip from the player who has lost the game or instructions to provide the chip to the player who has won the game.

* * * * *